United States Patent [19]

Yanagawa

[11] 4,403,851

[45] Sep. 13, 1983

[54] ELECTROSTATIC COPYING MACHINE COMPRISING IMPROVED ARRANGEMENT OF OPERATING UNITS

[75] Inventor: Nobuyuki Yanagawa, Tokyo, Japan

[73] Assignee: Ricoh Company, Ltd., Tokyo, Japan

[21] Appl. No.: 293,539

[22] Filed: Aug. 17, 1981

Related U.S. Application Data

[62] Division of Ser. No. 123,637, Feb. 22, 1980.

[30] Foreign Application Priority Data

Mar. 9, 1979 [JP] Japan ..... 54-28009

[51] Int. Cl.[3] ..... G03G 15/00

[52] U.S. Cl. ..... 355/14 R; 355/3 BE

[58] Field of Search ..... 355/14 R, 3 BE, 3 R, 355/11, 16

[56] References Cited

U.S. PATENT DOCUMENTS

| | | | |
|---|---|---|---|
| B500171 | 3/1976 | Doi et al. | 355/8 X |
| 3,445,626 | 5/1969 | Michaels | 355/3 FU |
| 3,792,924 | 2/1974 | Matsuda et al. | 355/3 BE |
| 3,836,245 | 9/1974 | Hastwell et al. | 355/14 R |
| 3,966,316 | 6/1976 | Pfeifer et al. | 355/15 X |
| 4,077,711 | 3/1978 | Akamatsu | 355/15 X |
| 4,084,901 | 4/1978 | Aasen et al. | 355/16 |
| 4,129,373 | 12/1978 | Ogura et al. | 355/1 |

*Primary Examiner*—R. L. Moses

*Attorney, Agent, or Firm*—David G. Alexander

[57] ABSTRACT

A cover (24) is hinged to the top of a housing (22) in such a manner as to be rockable from a closed position and an open position. A platen (23) is provided on top of the cover (24) for supporting an original document (26). A movable charging and scanning unit (32), endless photoconductive belt (27), cleaning unit (61) and fixing unit (54) are provided in the cover (24). A developing unit (39), sheet cassette (44), (46) and feed units and a transfer unit (41) are provided in the housing (22). The various units are easily detachable from the bottom of the cover (24) or the top of the housing (22), thus facilitating easy maintenance and removal of jammed sheets. The overall arrangement provides a substantial reduction in the size of the copying machine (21), especially in the vertical dimension. The apparatus is arranged and controlled in such a manner that for a multiple copying operation, the belt (27) is alternatingly stopped while the charging and scanning unit (32) forms an electrostatic image thereon and then driven for one half revolution. For a single copying operation, the belt (27) is stopped while the charging and scanning unit (32) forms an electrostatic image thereon and then driven for one revolution.

24 Claims, 17 Drawing Figures

ELECTROSTATIC COPYING MACHINE COMPRISING IMPROVED ARRANGEMENT OF OPERATING UNITS

CROSS REFERENCE TO RELATED APPLICATION

This application is a division of copending U.S. patent application Ser. No. 123,637, filed Feb. 22, 1980.

BACKGROUND OF THE INVENTION

The present invention relates to an improved electrostatic copying machine.

Electrostatic copying machines have been developed heretofore which provide high speed copying, copying on both sides of a sheet, high resolution and other advantages. However, some problems have remained in the overall design. One of such problems is that maintenance is difficult due to inaccessibility of component units. Sheet jams are hard to clear for the same reason. Another problem is that the overall size of the copying machines have been excessive due to wasted space caused by inefficient arrangement of operating components.

SUMMARY OF THE INVENTION

An electrostatic copying machine embodying the present invention comprises a housing, a cover provided on top of the housing and being movable between open and closed positions; first and second parallel rollers rotatably supported by the cover, an endless photoconductive belt trained around the first and second rollers, imaging means provided in the cover for forming an electrostatic image of an original document on a portion of the belt between the first and second rollers, developing means provided in the housing for developing the electrostatic image to produce a toner image, the developing means being adjacent to the first roller when the cover is in the closed position, transfer means provided in the housing for transferring the toner image to a copy sheet, the transfer means being adjacent to the second roller when the cover is in the closed position, and drive means for rotating the first and second rollers and thereby the belt in a direction such that the portion of the belt on which the electrostatic image is formed moves around the first roller and then around the second roller.

In accordance with the present invention, a cover is hinged to the top of a housing in such a manner as to be rockable between a closed position and an open position. A platen is provided on top of the cover for supporting an original document. A movable charging and scanning unit, endless photoconductive belt, cleaning unit and fixing unit are provided in the cover. A developing unit, sheet cassette and feed units and a transfer unit are provided in the housing. The various units are easily detachable from the bottom of the cover or the top of the housing, thus facilitating easy maintenance and removal of jammed sheets. The overall arrangement provides a substantial reduction in the size of the copying machine, especially in the vertical dimension.

It is an object of the present invention to provide an improved electrostatic copying machine which features easier maintenance due to easy detachability of component units.

It is another object of the present invention to provide an improved electrostatic copying machine which features easy removal of jammed sheets due to easy accessibility.

It is another object of the present invention to provide an improved electrostatic copying machine which features reduced size due to efficient arrangement of component units.

It is another object of the present invention to provide a generally improved electrostatic copying machine.

Other objects, together with the foregoing, are attained in the embodiment described in the following description and illustrated in the accompanying drawing.

DESCRIPTION OF THE PREFERRED EMBODIMENT

While the electrostatic copying machine of the present invention is susceptible of numerous physical embodiments, depending upon the environment and requirements of use, substantial numbers of the herein shown and described embodiment have been made, tested and used, and all have performed in an eminently satisfactory manner.

Figure 2:
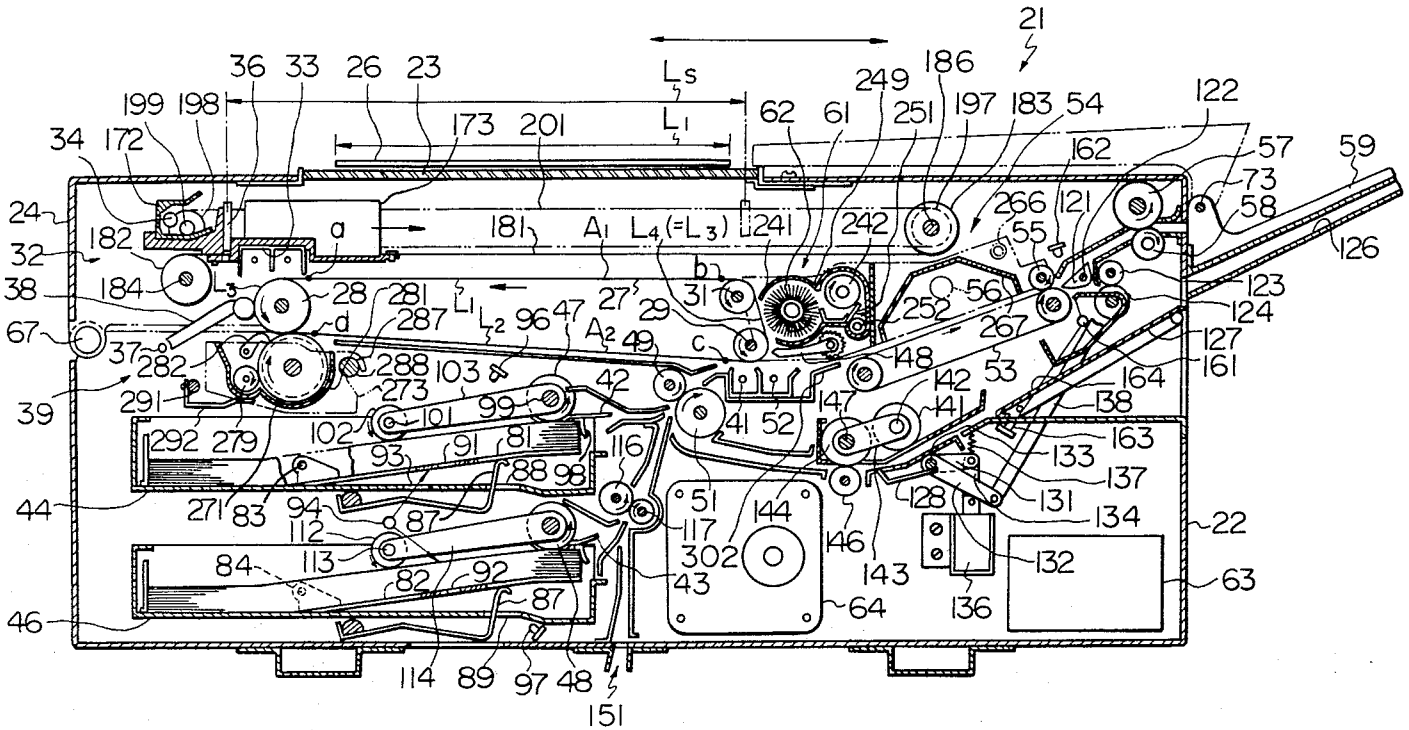
FIG. 2 is a side elevation of the internal components of the copying machine.

Referring now to FIG. 2 of the drawing, an electrostatic copying machine 21 comprises a housing 22 and a transparent glass platen 23 provided at the upper surface of a cover 24 of the housing 42. An original document 26 which is to be electrostatically reproduced is placed face down on the platen 23.

A photoconductive endless belt 27 is trained around parallel first, second and third rollers 28, 29 and 31 respectively below the platen 23. The outer surface of the belt 27 is coated with an OPC or similar photoconductive substance with the upper run of the belt 27 being parallel to the platen 23. An imaging unit 32 comprising a corona charging unit 33, a light source 34 and an optical focussing element 36 such as a converging lens or optical fiber array is moved rightwardly by a distance LS from a solid line position to a phantom line position to form an electrostatic image of the document 26 on the belt 27. This operation is performed while the belt 27 is held stationary. A lamp 37 and guide 38 are provided adjacent to the roller 28 to discharge portions of the belt 27 which are not used to form the electrostatic image, such as peripheral edge areas, to prevent toner from adhering to these areas. Rotation of the belt 27 in the counterclockwise direction after imaging causes the belt 27 move around the first roller 28. A developing unit 39 which is typically of the magnetic brush type develops the electrostatic image to produce a toner image. A transfer charger 41 is disposed adjacent to the roller 29. A top copy sheet 42 or 43 is fed from a stack in a cassette 44 or 46 by a feed roller 47 or 48 and register rollers 49 and 51 into engagement with the belt 27 as it moves around the roller 29. The copy sheet 42 or 43 is fed at the same surface speed as the belt 27 with the leading edge of the copy sheet 42 or 43 being in register with the leading edge of the toner image on the belt 27. A separation charger 52 causes the sheet 42 or 43 to separate from the belt 27 after toner image transfer and advance onto a conveyor belt 53. A fixing unit 54 comprising an Xenon flash tube 56 fixes the toner image to the copy sheet 42 or 43. The conveyor belt 53, which is rotated clockwise, conveys the finished copy via feed rollers 55, 57 and 58 into a discharge tray 59 from which the copy is removed for use. A cleaning unit 61 comprising a fur brush 62 is illustrated for removing residual toner from the belt 27. Further illustrated are a control unit 63 which may comprise a microcomputer and a drive unit 64 which control the operation of the copying machine 21 and drive the various components in a manner which will be described in greater detail below.

The length of the upper run of the belt 27 on which the electrostatic image is formed is equal to L1, which is the length of the maximum sized original document 26 which is to be copied. The length of the upper run L1 is designated at its opposite ends by the characters a and b respectively and designated in its entirety as an area A1. A similar length L2 which is equal to L1 is designated as A2 on the lower run of the belt 27 between points c and d. The length of the belt 27 around the roller 28 between the points a and d is designated as L3. The length of the belt 27 around the rollers 29 and 31 between the points c and b is equal to L4 which is also equal to L3. Although the entire outer surface of the belt 27 is preferably photoconductive and available for use in image formation, in accordance with the following description, images are only formed in the areas A1 and A2. As the belt 27 rotates by one half revolution, the area A1 occupies the position which was formally occupied by A2 and vice-versa.

By multiple copying it is meant that a plurality of copies are to be made in succession, either of the same original document or of different original documents. In a single copying operation, only one copy is to be made of a single original document.

The first step of a multiple copy process is to hold the belt 27 stationary and move the imaging unit 32 rightwardly from the solid line position to the phantom line position. The charger 33 forms a uniform electrostatic image on the area A1 while a light image of the document 26 illuminated by the light source 34 is progressively radiated onto the area A1 by the focussing element 36. The light image causes localized photoconduction of the belt 27 and the formation of an electrostatic image of the document 26 thereon.

In the next step of the process, the belt 27 is driven for one half revolution in the counterclockwise direction while the imaging unit 32 is returned to the solid line position. During this operation, the area A1 is moved around the roller 28 to occupy the position previously occupied by the area A2, and the electrostatic image is developed by the developing unit 39.

In the next step, the belt 27 is held stationary and the imaging unit 32 is moved rightwardly to form an electrostatic image of the same or another original document in the area A2.

In the next step, the belt 27 is driven for one half revolution and the imaging unit 32 is returned to the solid line position. During this operation, the first toner image in the A1 area is transferred to the copy sheet 42 or 43 by the transfer charger 41 and the second electrostatic image in the A2 area is developed by the developing unit 39.

In the next step, the belt 27 is stopped and the imaging unit 32 is moved rightwardly to form a third electrostatic image in the A1 area. In the last step, the belt 27 is driven for one half revolution and the imaging unit 32 is returned to the phantom line position. During this operation, the second toner image in the A2 area is transferred to the copy sheet 42 or 43 while the third electrostatic image in the A1 area is developed.

These operations are repeated until all desired copies are produced. For the last copy, the belt 27 is driven for one complete revolution after imaging so that the last electrostatic image will be developed during the first one half revolution and the resulting toner image transferred to the copy sheet 42 or 43 during the second half revolution. During continuous operation, each one half revolution of the belt 27 results in development of one toner image and transfer of a prior toner image.

For making a single copy, the procedure is the same as for making the last copy in a multiple copying operation. The belt 27 is held stationary while the electrostatic image of the document is formed, and then driven for one complete revolution.

The developing unit 39 is pivotally mounted on a shaft 288 and is movable thereby into and out of engagement with the belt 27. The operation is such that the developing unit 39 is moved into engagement with the belt 27 while the belt 27 is moving, and moved out of engagement with the belt 27 while the belt 27 is stopped. This prevents erroneous deposition of toner on the belt 27 and further prevents toner from being scattered about the interior of the housing 22.

The fur brush cleaning unit 61 is controlled in such a manner that the brush 62 is rotated while the belt 27 is moving and stopped while the belt 27 is stopped. The brush 62 is disposed between the rollers 29 and 31 and applies tension to the belt 27 which prevents vibration during imaging. A further advantage of this arrangement is that a mechanism required for moving the brush 62 out of engagement with the belt 27 when the belt 27 is not moving as is provided in the prior art is eliminated.

A feature of the present invention resides in the provision of the developing unit 39 adjacent to the roller 28 and the transfer unit 41 adjacent to the roller 29. This allows a major reduction in the diameters of the rollers 28, 29 and 31 and thereby a reduction in the time required for the copying operation.

Figure 3:
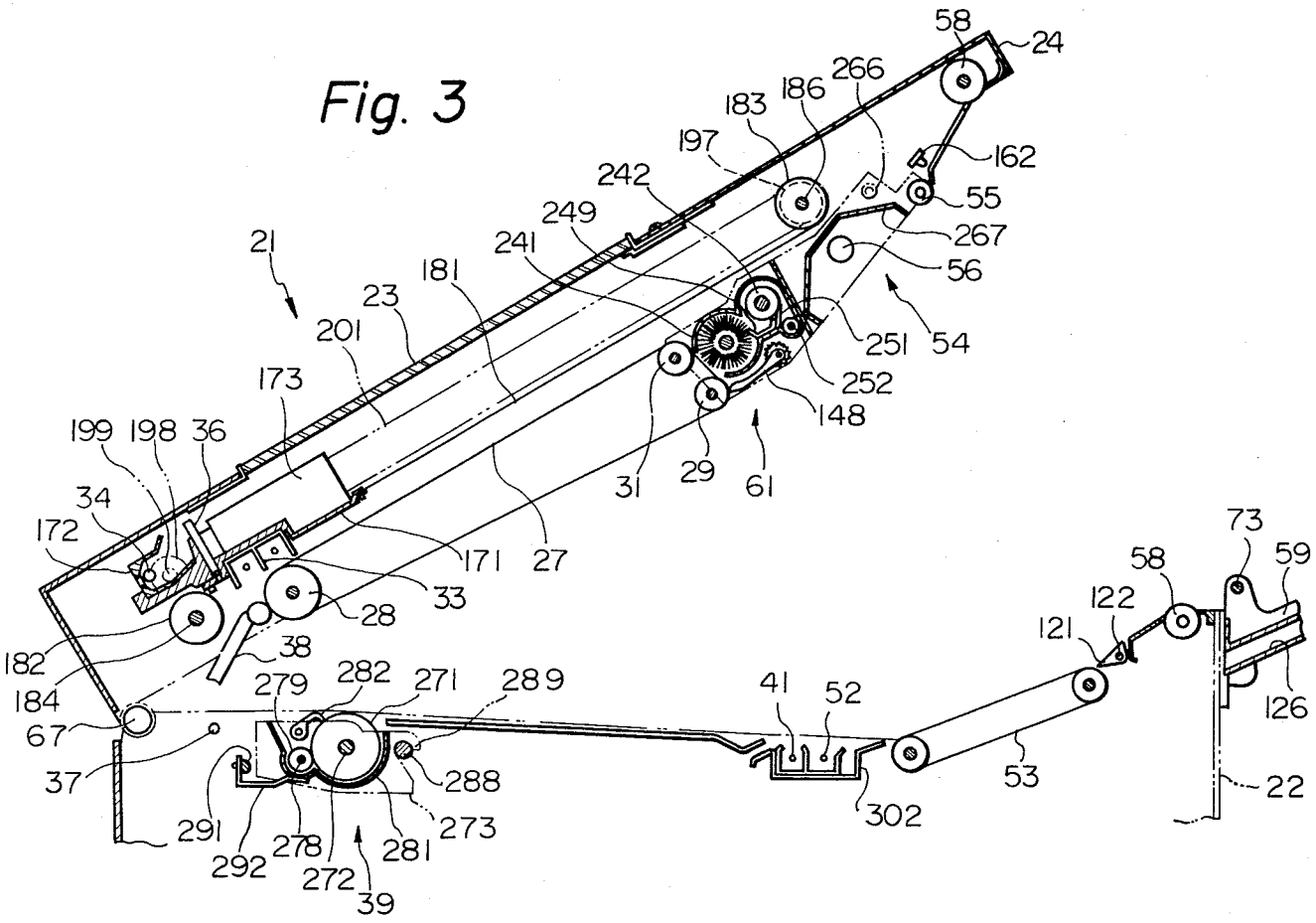
FIG. 3 is similar to FIG. 2 but shows a cover in a raised or opened position.

Referring to FIG. 3, it will be seen that the cover 24 is rockable attached to the top of the housing 22 by means of a hinge comprising a shaft 67 about which the cover 24 is rockable. The cover 24 may thereby be rocked from a closed position shown in FIG. 2 to an open position shown in FIG. 3. In the open position, the cover 24 is held open by a latch, friction means or similar arrangement.

The illustrated arrangement enables easy maintenance, sheet jam clearing and space reduction and thereby constitutes a major improvement over the prior art. As will be described in detail below, the various component units are easily detachable from the bottom of the cover 24 or from the top of the housing 22 when the cover 24 is in the open position of FIG. 3. The belt 27, cleaning unit 61 and fixing unit 54 are easily removed from the bottom of the cover 24. With the belt 27 removed, the imaging unit 32 may be easily serviced.

The developing unit 39, transfer unit 51, separation charger 52 and conveyor belt 53 are easily removed from the top of the housing 22. This also enables jammed sheets to be easily removed from the top of the housing 22. As yet another advantage, the imaging unit 32, belt 27 and other units form a very flat arrangement which is efficient from the point of view of space utilization and substantially reduces the size of the copying machine 21, especially in the vertical dimension. Another advantage is that toner can be easily added to the developing unit 39. The modular arrangement featuring easy accessibility simplifies the manufacture of the copying machine 21 and facilitates any type of maintenance including cleaning, repair or replacement of component units.

The various units of the copying machine 21 will now be described in detail with reference to the drawing.

Figure 1:
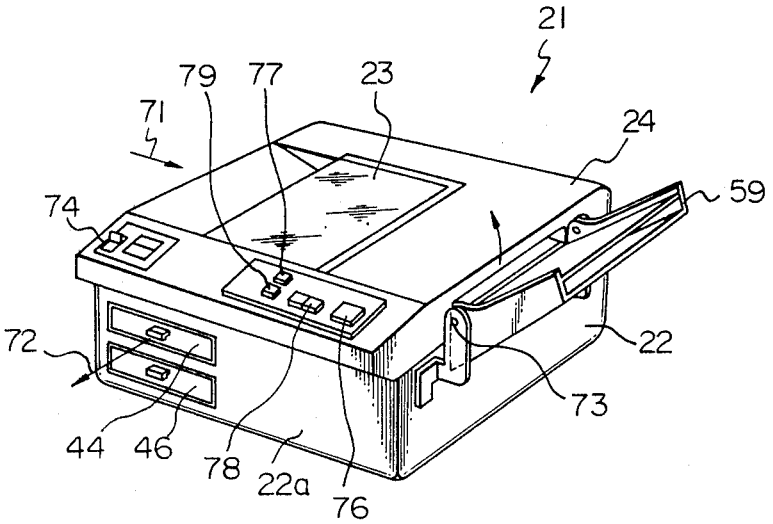
FIG. 1 is a perspective view of an electrostatic copying machine embodying the present invention.

FIG. 1 shows the overall configuration of the exterior of the copying machine 21. The cassettes 44 and 46 hold different sizes of copy sheets such as A4 and B4 and are inserted into a front 22*a* of the housing 22. The sheets 42 and 43 are fed out of the cassettes 44 and 46 respectively in the rightward direction as indicated by an arrow 71 parallel to the front 22*a* of the housing 22 whereas the cassettes 44 and 46 are removed from the housing 22 in the direction of an arrow 72 perpendicular to the front 22*a* of the housing 22. The cassettes 44 and 46 are completely received in the housing 22 without protruding therefrom. Whereas in prior art copying machines the cassettes protrude from the side walls of the housing, for example the left wall, in the present invention they are completely enclosed in the housing 22. This allows the copying machine 21 to be installed in a reduced space with the left wall of the housing 22 flush with a wall. This is impossible in the prior art due to the cassettes protruding from the left wall of the housing. It will also be seen in FIG. 2 that the receiving tray 59 may be folded onto the upper surface of the cover 24 for easy transport of the copying machine 21, since the tray 59 is rotatably mounted about a shaft 73. Preferably, a latch (not shown) is provided to hold the cassettes 44 and 46 in place in the housing 22. The latch is released for insertion or removal of the cassettes 44 and 46.

Further illustrated in FIG. 1 are a switch 74 for selecting whether copying is to be performed on one or both sides of the sheet, a print start button 76, a button 77 for causing copying on the first sides of sheets, a button 79 for causing copying on the second sides of sheets and a counter 78 for setting in a desired number of copies.

Figure 4:
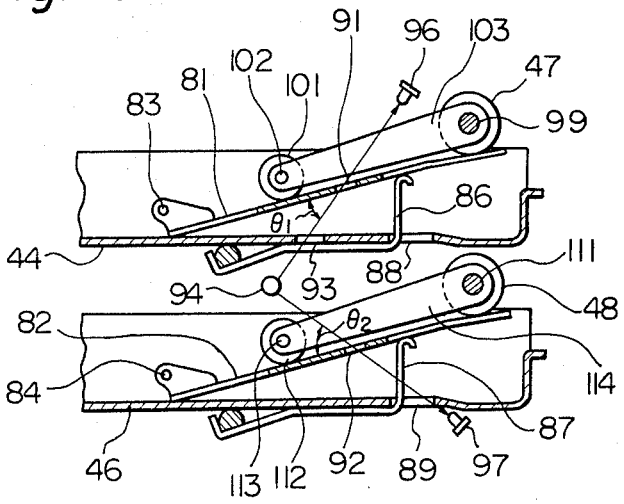
FIG. 4 is an elevation illustrating sheet cassettes.

Referring now to FIG. 4, the cassettes 44 and 46 comprises plates 81 and 82 which are hinged to the bottoms of the cassettes 44 and 46 by pins 83 and 84 respectively. Rotary arms 86 and 87 extend through holes 88 and 89 formed in the bottoms of the cassettes 44 and 46 and push the plates 81 and 82 upwardly toward engagement with the feed rollers 47 and 48 respectively. In this manner, the top sheets 42 and 43 (if present) engage the rollers 47 and 48 respectively for feeding. It the sheets 42 and 43 are not present, the plates 81 and 82 will engage the rollers 47 and 48 respectively.

The plates 81 and 82 are formed with holes 91 and 92 respectively. In addition, a hole 93 is formed through the bottom of the cassette 44. A single light source 94 is provided between the cassettes 44 and 46. Photosensors 96 and 97 are provided above the cassette 44 and below the cassette 46 respectively. When the plates 81 and 82 are inclined at angles $\theta 1$ and $\theta 2$ as illustrated, the holes 91 and 93 align with a line connecting the light source 94 and photosensor 96 and the holes 92 and 89 align with a line connecting the light source 94 and photosensor 97. If the plates 81 and 82 are aligned at angles smaller than $\theta 1$ and $\theta 2$, the holes will not line up and the photosensors 96 and 97 will be blocked. The plates 81 and 82 incline to a greater extent as the number of sheets in the cassettes 44 and 46 decreases. Naturally, the cassettes 44 and 46 operate independently so that one or the other of the photosensors 96 and 97 may be uncovered.

Even if the plates 81 and 82 are inclined at the angles $\theta 1$ and $\theta 2$, the photosensors 96 and 97 will still be blocked if there is at least one sheet 42 or 43 remaining in the cassettes 44 and 46 respectively. Thus, the sheet 42 or 43 will block the photosensor 96 or 97 respectively. However, when the last sheet 42 or 43 is fed out of the cassette 44 or 46, the photosensor 96 or 97 respectively will be unblocked and produce an output. This indicates that the cassette 44 or 46 is empty and produces an indication such as a light (not shown) to instruct the operator to put more sheets in the respective cassette. This arrangement is advantageous in that only a single light source 94 is required and the wiring is simplified.

In the case of very thin sheets such as tracing paper, second original sheets for offset printing and overhead projection sheets, there is a tendency for the photosensors 96 and 97 to produce outputs when a small number of sheets remains in the respective cassettes 44 and 46. This is because the sheets are semitransparent and transmit a certain amount of light. The problem is most pronounced where the angle of incidence of light from the source approaches 90°, and may be overcome by making the angle of incidence suitably oblique.

Preferably the cassettes 44 and 46 are supported by rollers, ball bearings or the like for smooth insertion and detachment, although not shown.

Electrostatic copying machines typically comprise a cassette for holding a stack of copy sheets. Such a cassette includes a bottom plate for supporting the stack which is raised so that the top sheet of the stack engages with feed rollers provided above the cassette. A corner separator is provided at the leading edge corners of the stack such that when the feed rollers are rotated the top sheet is fed toward the corner separators. The corner separators cause the leading edge of the copy sheet to flex and pop out of the cassette for feeding to register rollers and a transfer station.

A problem has existed heretofore regarding skew feed of the copy sheet. This occurs when the copy sheets are closer to one side of the cassette than the other or when the copy sheets are not stacked evenly in the cassette. This latter condition also results in a particular copy sheet being closer to one side of the cassette than the other. Under such conditions, the result is that one of the corner separators exerts a greater force on the leading edge of the sheet than the other corner separator so that a rotational moment is imparted to the copy sheet about its center of gravity. The rotation of the copy sheet results in skew feed such that the side edges of the copy sheet are not parallel to the feed direction. Assuming that the skewed copy sheet does not jam in the feed path of the copying machine, which often happens, the copy image will appear tilted on the copy sheet.

In the prior art system described above, a feed roller must be provided adjacent to each corner separator, and the rollers must be spaced equally from the side edges of the copy sheets to prevent rotational moments and skew feed. However, it is desirable to be able to produce copies on different sizes of copy sheets, such as ISO sizes A4, B4, B5, etc.

It is possible to provide several copy sheet sizes using a single set of feed rollers. In one case cassettes of different sizes are provided and selectively inserted in the copying machine frame below the feed rollers. In another system a single cassette is provided and the stack of copy sheets is placed in the cassette in alignment with a front edge and a side edge of the cassette. In each case, it is necessary to provide a separate feed roller for the other side edge of the copy sheet corresponding to each sheet size. For example, if the copying machine is designed to utilize A4, B4 and B5 size sheets, there must be at least four feed rollers; one for the aligned side edge and three for the non-aligned side edges. The disadvantage of this arrangement is that a rotational moment is imparted to the sheet for the larger sheet sizes due to the fact that more than one feed roller engages the non-aligned side edge portion of the sheet resulting in skew feed.

A prior art proposal to overcome this problem is to slidably mount a single non-aligned side edge feed roller and position it in accordance with the sheet size. If the roller is positioned automatically, a complicated mechanism is required. If the roller is positioned manually, it will often be moved to the wrong position or neglected by inexperienced or careless operators with the inevitable result of skew feed.

Figure 5:
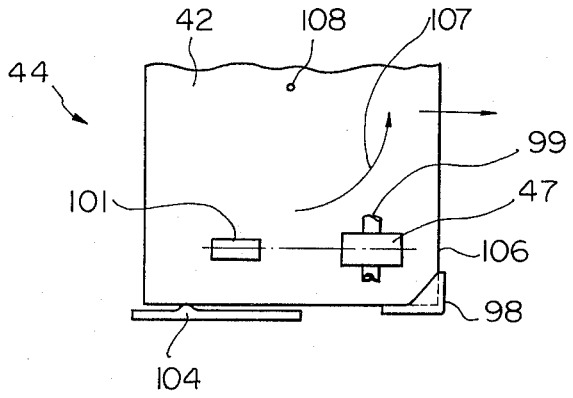
FIG. 5 is a plan view illustrating a corner separator and sheet feed means.

These problems are overcome in the present copying machine 21 as illustrated in FIG. 5. The cassette 44, which is taken for purpose of example, is provided with a single corner separator 98 disposed adjacent to the roller 47.

The roller 47 is fixed to a rotary shaft 99 for integral counterclockwise rotation to feed the top sheet 42 rightwardly from the cassette 44 into the bite of the register rollers 49 and 51. A skew preventing roller 101 is rotatably mounted via a pin 102 to the end of an arm 103 which is in turn rotatably supported by the shaft 99. The roller 101 is urged downwardly by gravity into pressing engagement with the top sheet 42. It will be noted that the roller 101 is provided parallel to and upstream of the roller 47 in the direction (rightward) of feeding of the sheet as viewed in FIG. 5.

The stack of sheets 42 are aligned with a right side wall 104 of the cassette 44 as well as with a leading edge as indicated at 106. The sheet 42 is fed upwardly by the single feed roller 47 as viewed in FIG. 4. It will be noted that the sheets 42 may be of any size since they are aligned with the edges 104 and 106 and thereby the corner of the cassette 44 and fed by only one feed roller 47.

However, since only one feed roller 47 is provided, a counterclockwise moment as indicated at 107 is imparted to the sheet 42 about its center of gravity 108. This moment, without compensation as provided by the present invention, would cause the sheet 42 to rotate or skew counterclockwise. The right edge of the sheet 42 would pop up over the top of the wall 104 and allow the sheet 42 to be fed in a highly skewed manner.

This action is prevent by the roller 101. Although the roller 101 is free to rotate and allow the sheet 42 to be fed straight, it presents a high degree of frictional resistance to movement perpendicular to the direction of sheet feed. This results in a clockwise moment. The skew preventing moment is increased by displacing the roller 101 rightwardly of the roller 61 which is selected so that all moments cancel. This allows the sheet 42 to be fed straight by only one feed roller 47. The position of the roller 101 is selected to cancel the moment 107 introduced by the feed roller 47 as well as a moment introduced by resistance of the corner separator 98, a moment introduced by resistance of the side wall 104 and a moment introduced through friction between the top sheet 42 and the lower sheets of the stack. This enables the present apparatus 21 to straightly feed sheets of any size, even postcard size, and also enables transverse feed.

The distance between the rollers 101 and 47 is selected to be as large as possible to maximize the skew preventing effect of the roller 101. In order to ensure skew preventing action however, the roller 101 must still engage the sheet 42 when the sheet 42 enters the bite of the register rollers 49 and 51.

The cassette 46 is provided with a shaft 111, skew preventing roller 112, pin 113 and arm 114 in the same manner as the cassette 44. Further illustrated are auxiliary feed rollers 116 and 117 which are visible in FIG. 2 disposed between the cassette 46 and register rollers 49 and 51. The latch mechanism further comprises actuator means (not shown) to move the rollers 101 and 112 as well as the arms 86 and 87 out of the cassettes 44 and 46 for removal and insertion of the respective cassettes 44 and 46.

The copying machine 21 is capable of copying either on one side of, for example, the sheets 42 or on both sides of the sheets 42. As further illustrated in FIGS. 6 to 8, the copying machine 21 comprises a pawl 121 which is mounted on a rotary shaft 122 and movable between a position shown in FIG. 6 in which the pawl 121 deflects the sheet 42 into the tray 59 and a position shown in FIG. 7 in which the pawl 121 deflects the sheet 42 into the bite of feed rollers 123 and 124 which feed the sheet 42 into a rectangular tunnel 126 in the tray 59. When the trailing edge of the sheet 42 clears the rollers 123 and 124, the sheet 42 drops down on an inclined plate 127 which extends downwardly from the bottom of the tunnel 126. The sheet 42 slides leftwardly down the plate 127 until the leading edge thereof abuts against a stop 128. This operation is illustrated in FIGS. 7 and 8. The plate 127 is capable of supporting, for example, 20 sheets 42. Thus, it is possible to make up to 20 copies on both sides of the sheet in a single operation.

Arms 131 and 132 are fixed to a rotary shaft 133. The arm 131 is pivotally connected to a plunger 134 of a solenoid 136 and biased to a counterclockwise position shown in FIG. 6 by a spring 137. The arm 132 is also rotated counterclockwise and pushes a link 138 upwardly. The ends of the arm 132 and link 138 are pivotally connected together. The other end of the link 138 is pivotally connected to the end of an arm 139 which is fixed to the shaft 122. Upward movement of the link 138 rotates the arm 139 and thereby the pawl 121 counterclockwise to the position of FIG. 6 for deflection of the sheets 42 into the tray 59. For copying on the first sides of sheets 42 where it is desired to copy on both sides, the solenoid 136 is energized and the plunger 134 pulled downwardly against the force of the spring 137. This rotates the arms 131 and 132 clockwise and pulls the link 138 downwardly, causing the arm 139 and pawl 121 to rotate clockwise to the position of FIGS. 7 and 8 to deflect the sheets 42 into the tunnel 126.

Figure 6:
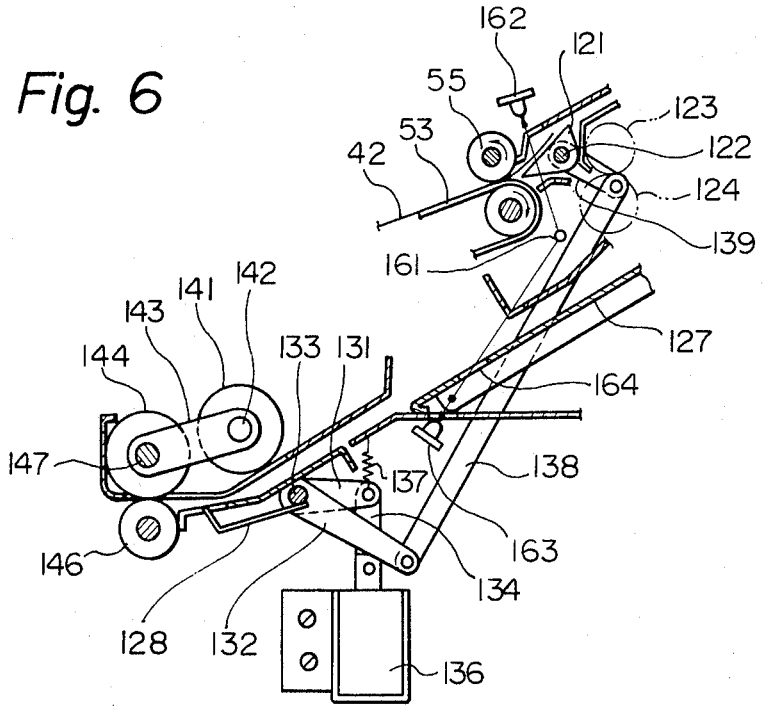
FIG. 6 is an elevation illustrating a sheet inverting mechanism in a non-inverting position.
Figure 7:
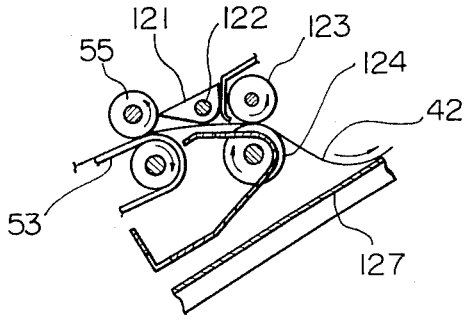
FIG. 7 is a fragmentary elevation illustrating the sheet inverting mechanism at a beginning of sheet inversion.
Figure 8:
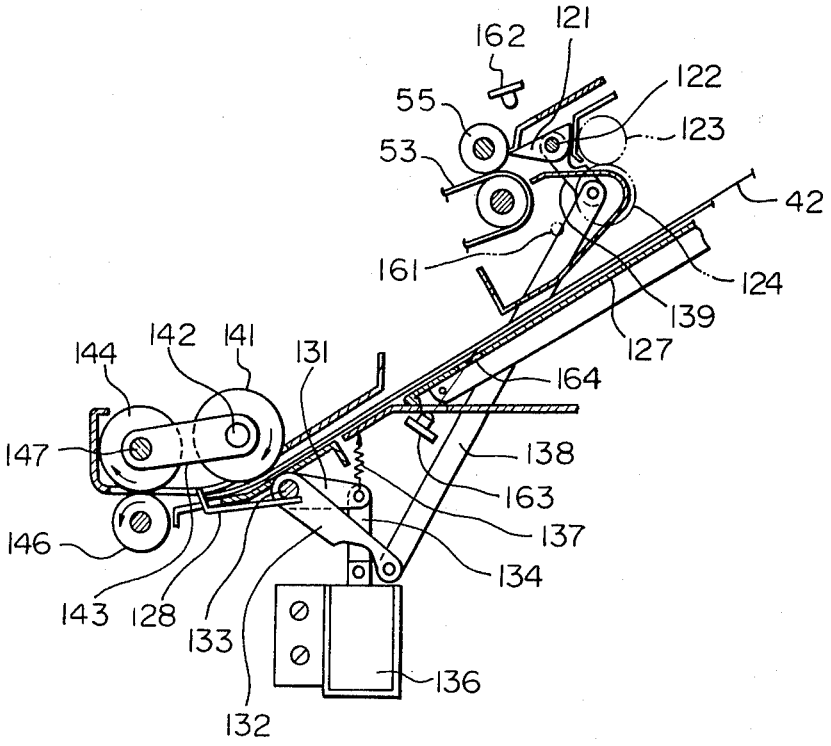
FIG. 8 is similar to FIG. 6 but shows the sheet inverting mechanism at an end of sheet inversion.

The stop 128 is also fixed to the shaft 133 and moved downwardly in FIG. 6 to allow feeding of sheets 42 from the plate 127 and upwardly in FIGS. 7 and 8 to stop the sheets 42 and hold them on the plate 127. Further illustrated is a feed roller 141 which is driven for rotation in the clockwise direction and normally held away from the plate 127 as illustrated in FIG. 6. This prevents feeding of sheets 42 from the plate 127 and allows the sheets 42 to reach the stop 128. After the operation of copying on the first side of all of the desired sheets 42 has been completed and the sheets 42 have been stacked on the plate 127, the solenoid 136 is de-energized so that the various components assume the positions of FIG. 6. In addition, the roller 141 is lowered to feed the top sheet 42 into the bite of feed rollers 144 and 146. The roller 144 is fixed to a rotary shaft 147. The shaft 142 is rotatably supported by an arm 143 which is in turn rotatably supported by the shaft 147. This allows the roller 141 to be pivoted toward and away from the plate 127.

To copy on the second sides of the sheets 42, the original document 26 is turned over or replaced with another document. However, the sheets 42 are not fed to the belt 27 for toner image transfer from the cassette 44 but from the plate 127 by means of the rollers 141, 144 and 146. These rollers feed the sheets 42 from the plate 127 to the register rollers 49 and 51 one at a time just as the sheets 42 were fed from the cassette 44 to copy on the first sides thereof. Further illustrated is a pawl 148 which aides in separation of the sheets 42 from the belt 27. Typically, the transfer charger 41 apply a charge having a polarity opposite to the charge of the toner to the backs of the sheets 42 whereas the separation charger 52 will apply an A.C. charge.

It is important to understand that the sheets 42 are inverted by the plate 127 and associated mechanism so that the second toner images are transferred to the second sides thereof. Naturally, copying may be performed on both sides of the sheets 43 in the same manner. The solenoid 136 is de-energized while the sheets 42 are being fed from the plate 127 so that the stopper 128 is moved out of the way and the pawl 121 deflects the sheets 42 into the tray 59. In summary, the solenoid 136 is energized for copying on the first sides of the sheets 42 to stack the sheets 42 on the plate 127 after transfer of the toner images to the first sides thereof. Then, the solenoid 136 is de-energized to feed the sheets 42 to the belt 27 for transfer of toner images to the second sides thereof after which the sheets 42 are discharged into the tray 59. For copying on only one side of the sheets 42, the solenoid 136 is maintained de-energized and the sheets 42 discharged into the tray 59 after transfer of the toner images to the first sides thereof. The process of feeding the sheets 42 onto the plate 127 has the effect of inverting the sheets so that the opposite sides contact the belt 27 for the second toner image transfer. This is accomplished by feeding the sheets 42 into the tunnel 126 in the rightward direction and feeding the sheets 42 from the tunnel 126 onto the plate 127 in the leftward direction.

Figure 9:
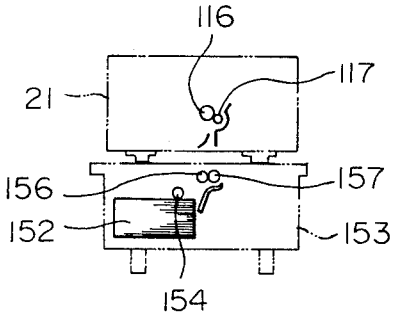
FIG. 9 is a schematic elevation illustrating means for increasing the sheet capacity.

The tunnel 126 is open at its rightward end to allow sheets to be manually fed onto the plate 127 for copying. In this case, the sheets 42 and 43 are not used. An opening 151 is formed through the bottom of the housing 22 below the feed rollers 116 and 117. This enables sheets 152 to be fed to the belt 27 from an auxiliary sheet box 153 which is shown in FIG. 9. Whereas the cassettes 44 and 46 have a capacity of about 250 sheets, the box 153 is designed to accommodate up to 1000 sheets 152. The box 153 is provided with feed rollers 154, 156 and 157 to feed the sheets 152 one by one upwardly through the opening 151 to the feed rollers 116 and 117 and therefrom to the register rollers 49 and 51 and to the belt 27.

Further illustrated is a light source 161 which illuminates a photosensor 162 above the pawl 121 and a photosensor 163 below the plate 127 via a hole 164 formed through the plate 127. This arrangement functions to sense for the presence of sheets at the right end of the conveyor 53 and on the plate 127 using the photosensors 162 and 163 respectively.

The photosensor 162 is combined with a timer (not shown) to sense for jamming of a sheet 42 in the vicinity of the right end of the conveyor 53. The photosensor 162 is blocked when the leading edge of the sheet 42 passes thereby. The photosensor 162 is unblocked with the trailing edge of the sheet 42 passes thereby. If the photosensor 162 is blocked greater than a predetermined length of time, it means that the sheet 42 jammed. Thus, an indication of the jam will be given to the operator. If desired, the belt 53 and rollers 55, 57 and 58 may be forcibly driven in response to the jam indication to feed the jammed sheet into the tray 57.

Figure 10:
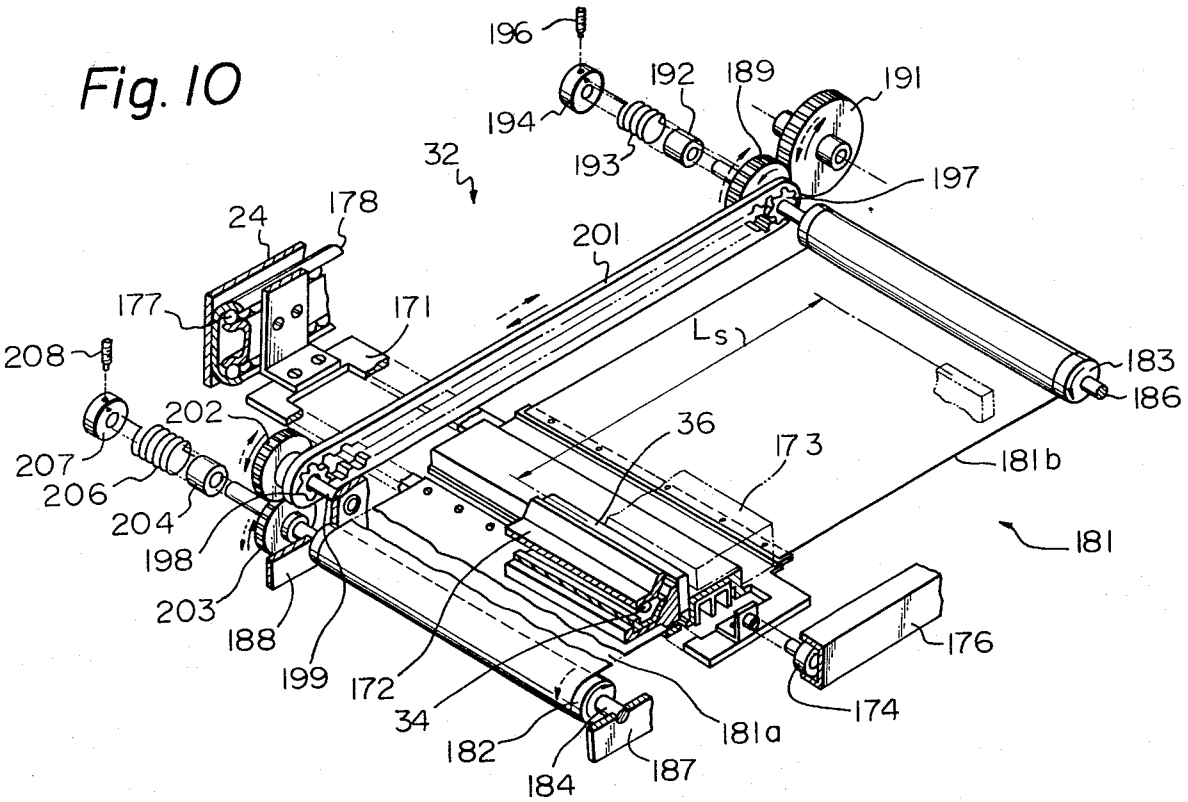
FIG. 10 is a partially exploded perspective view of a scanning unit of the copying machine.
Figure 11:
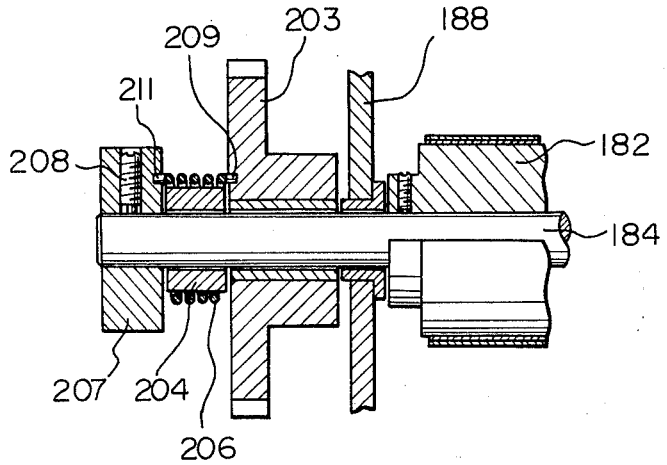
FIG. 11 is a longitudinal section of biasing means for curtain rollers of the scanning unit.

FIGS. 10 and 11 illustrate the imaging unit 32 in greater detail as comprising a carriage 171 which supports the light source 34, a reflector 172 for the light source 34, the charger 33, the array 36 and a high voltage power supply 173 for the charger 33. One end of the carriage 171 is supported by means of a roller 174 which rides in a channel 176 attached to the front of the cover 24. The other end of the carriage 171 is supported by a bearing 177 which rides in a channel 178 attached to the rear of the cover 24. In this manner, the carriage 171 and the component units which it supports are movable through the distance LS as illustrated in a straight and friction-free manner.

The unit 32 further comprises a curtain 181 which is wound around rollers 182 and 183 at its opposite ends. The curtain 181 is formed in two sections, **181*a* and 181*b* which are attached to the left and right ends respectively of the carriage 171. Since the reflector 172, charger 33 and power supply 173 are opaque, light reflected from the document 26 is only able to reach the belt 27 through the imaging array 36. In other words, the purpose of the curtain 181** is to block light reflected from the document 26 so that the only light which reaches the belt 27 is that focussed by the array 36.

The rollers 182 and 183 are mounted on shafts 184 and 186 respectively, the opposite ends of which are rotatably supported by frame members 187 and 188. A gear 189 is rotatably mounted on the shaft 186 and meshes with a drive gear 191 connected to the drive unit 64. A sleeve 192 is also rotatably mounted on the shaft 186 with a torsion spring 192 loosely fitted around the sleeve 192. A collar 194 is initially rotatably fitted on the shaft 186 during assembly. The ends of the spring 193 fit in holes in the facing surfaces of the gear 189 and collar 194. Then, the collar 194 is rotated clockwise and locked in place with a setscrew 196. When released, the spring 193 will apply a counterclockwise force to the shaft 186 and roller 183 which will urge the curtain section 181*b* to wind around the roller 183 and be stretched taut.

A sprocket 197 is fixed to the shaft 186 whereas a sprocket 198 is fixed to a stub shaft 199 which is rotatably supported by the frame member 188. A timing belt 201 is trained around the sprockets 197 and 198. A gear 202 which is also fixed to the shaft 199 meshes with a gear 203 which is rotatably mounted on the shaft 184.

A sleeve 204 and torsion spring 206 are rotatably mounted on the shaft 184. A collar 207 is initially rotatably mounted on the shaft 184 during assembly. The ends of the spring 206 fit into holes 209 and 211 in the facing surfaces of the gear 203 and collar 207 respectively as shown in FIG. 11. Then, the collar 207 is rotated clockwise and locked in place with a setscrew 208. When released, the spring 206 will urge the shaft 184 and roller 182 to rotate counterclockwise and thereby urge the curtain section 181*a* to wind around the roller 182 and be stretched taut.

The imaging unit 32 and curtain 181 are moved rightwardly (in the scan direction) by rotating the gear 191 clockwise. Scan movement is indicated by solid line arrows whereas return movement is indicated by phantom line arrows. Clockwise rotation of the gear 191 causes the gear 189 to rotate counterclockwise. This applies a counterclockwise force to the shaft 186 through the spring 193 and collar 194 which causes the curtain 181 to wind around the roller 183 and move the imaging unit 32 rightwardly.

Counterclockwise rotation of the shaft 186 causes the sprocket 197, timing belt 201, sprocket 198, shaft 199 and gear 202 to also rotate counterclockwise. This causes the gear 203 to rotate clockwise and apply a clockwise force to the shaft 184 through the spring 206 and collar 207. This causes the roller 182 to rotate clockwise and unwind the curtain 181 therefrom. The sprockets 197 and 198 and gears 202 and 203 are selected to have the same diameters. Thus, the rollers 182 and 183 are rotated in opposite directions by the same amount. In this manner, the curtain 181 is smoothly wound around the roller 183 and unwound from the roller 182 by the same amount, thereby moving the imaging unit 32 rightwardly. The springs 193 and 206 bifunction to maintain the curtain 181 taut and act as transmission elements. Counterclockwise rotation of the gear 191 causes the timing unit 32 and curtain 181 to move leftwardly in an essentially opposite manner.

Figure 12:
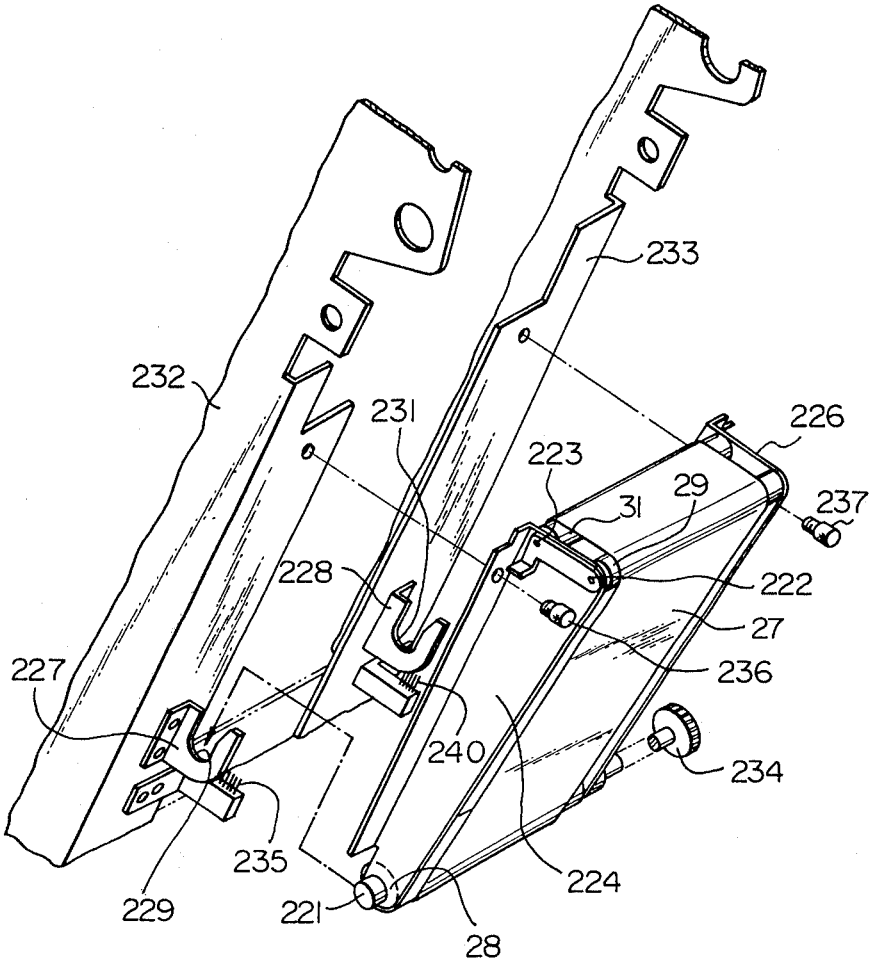
FIG. 12 is an exploded perspective view of a photoconductive belt assembly.

As illustrated in FIG. 12, the rollers 28, 29 and 31 around which the photoconductive belt 27 is trained are fixed to shafts 221, 222 and 223 respectively which are rotatably supported at their ends by frame members 224 and 226. Angle brackets 227 and 228 formed with semicircular cutouts 229 and 231 are fixed to the lower surfaces of frame members 232 and 233 which are in turn attached to the inside of the cover 24. A drive gear 234 is fixed to the shaft 221. The belt 27 and associated components are mounted on the frame members 232 and 233 by inserting the shaft 221 into the cutouts 229 and 231 and fastening the right end portion of the frame members 224 and 226 to the frame members 232 and 233 with screws 236 and 237 respectively. It will be understood that this arrangement is extremely advantageous since the belt 27 and associated members may be attached and detached from the inside of the cover 24 quickly and easily with the cover 24 in the open position. Further illustrated are grounded brushes 235 and 240 which engage with the belt 27 and discharge peripheral areas thereof.

Figure 13:
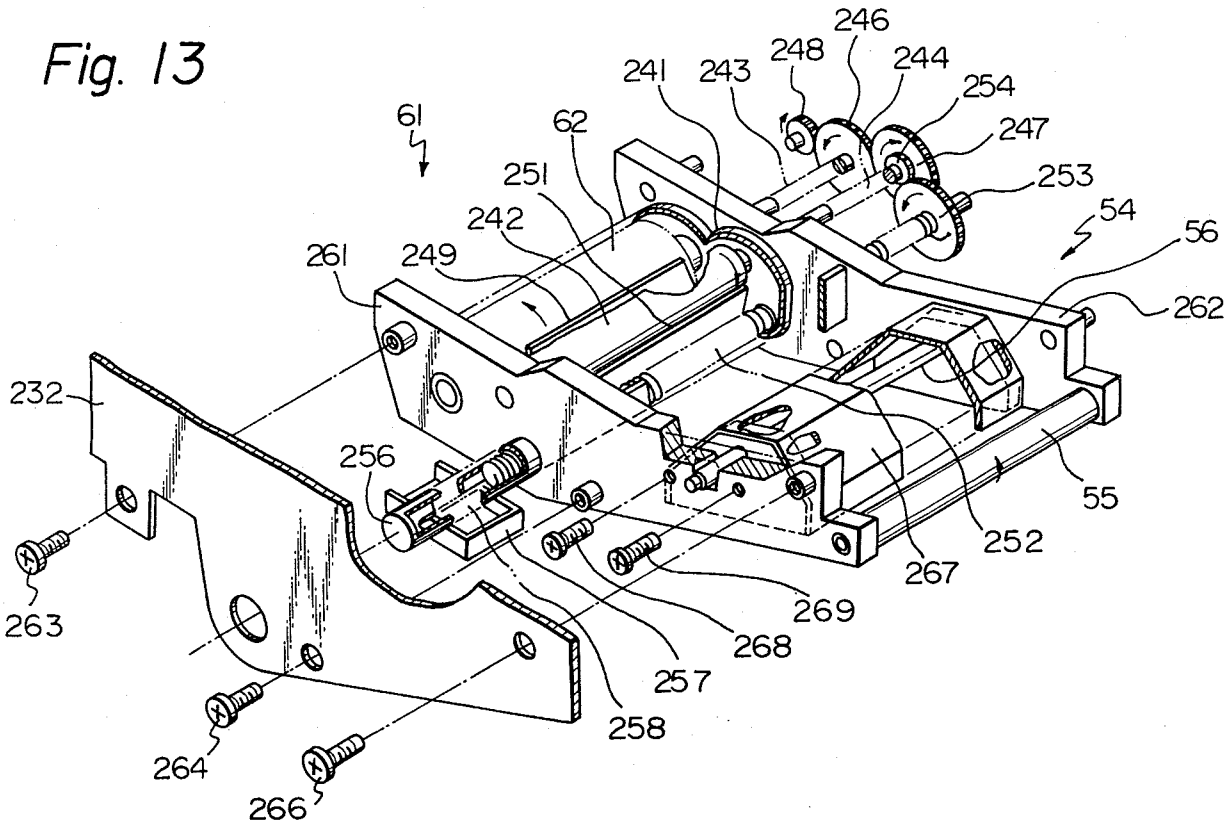
FIG. 13 is an exploded perspective view of a cleaning and fixing unit assembly.

The cleaning unit 61 is illustrated in FIG. 13 as comprising a double cylindrical housing 241 which encloses the fur brush 62 and an electrically conductive roller 242. The fur brush 62 and roller 242 are fixed to shafts 243 and 244, with meshing gears 246 and 247 being fixed to the shafts 243 and 244 respectively. A drive pinion 248 engages with the gear 246 and is rotated clockwise. This causes the fur brush 62 to rotate counterclockwise and brushingly remove residual toner from the belt 27.

A flicker bar 249 engages with the brush 62, deforming the bristles thereof and causing the toner to be flicked from the brush 62 into a circular path around the roller 242. The roller 242 is preferably applied with a potential having a polarity opposite to the charge on the toner, thus causing the toner to be attracted and adhered to the roller 242. A scraper blade 251 engages with the roller 242 and scrapes the toner off the roller 242 onto a worm in the form of a coil spring 252.

A gear 253 is fixed to the spring 252 which meshes with a gear 254 fixed to the shaft 244. This causes the gear 253 and spring 252 to rotate counterclockwise. The lead of the spring 252 is selected so that the spring 252, when rotated counterclockwise, will convey the toner through a tube 256 to a receptacle 257 for reuse. A hole 258 is formed in the bottom of the tube 256 above the receptacle 257 to allow the toner to fall into the receptacle 257.

As discussed above, the pinion 248 is driven while the belt 27 is moving and stopped while the belt 27 is stopped. This prevents shaking of the belt 27 during imaging and also prevents toner from being scattered about the interior of the copying machine 21.

The shafts 244 and 248 as well as the spring 252 are rotatably supported by frame members 261 and 262 which are in turn detachably mounted to the frame members 232 and 233 by screws 263, 264, 266 and other screws which are not visible in the drawing. The fixing unit 54 and roller 55 are also supported by the frame members 261 and 262. The fixing unit 54 comprises a reflector 267 which supports the flash tube 56 and is attached to the frame members 261 and 262 by screws 268 and 269 and other screws which are not visible. The flash tube 56 is fired repeatedly to generate heat and fuse the toner image to the copy sheets. The arrangement of FIG. 13 is very advantageous since the cleaning unit 61, fixing unit 54 and roller 55 may be easily removed from the bottom of the cover 24 merely by detaching the frame members 261 and 262 from the frame members 232 and 233.

Figure 16:
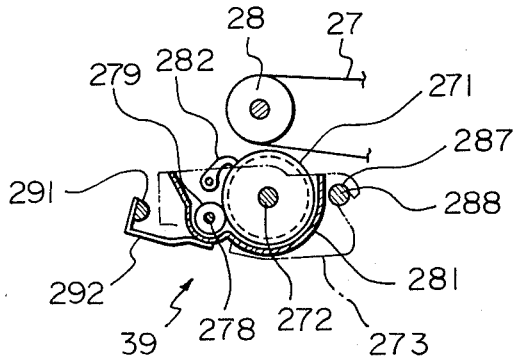
FIG. 16 is a schematic elevation further illustrating the developing unit.
Figure 14:
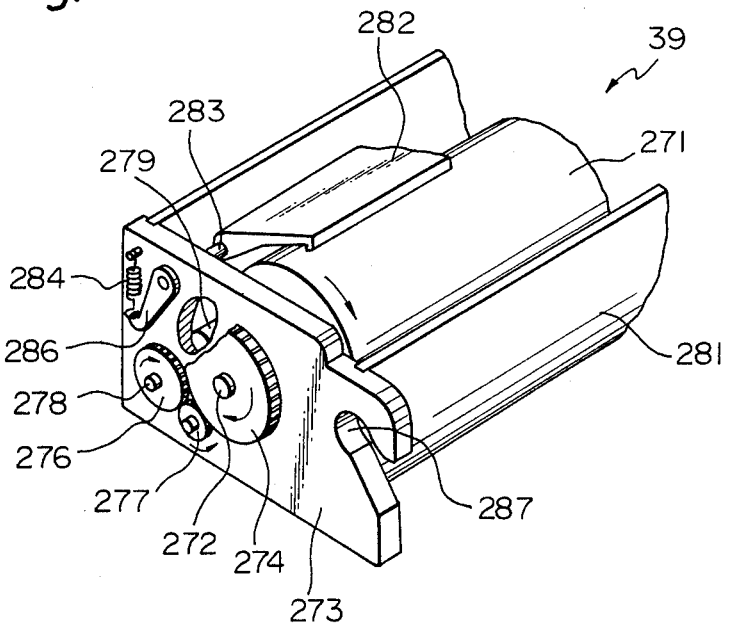
FIG. 14 is a perspective view of a developing unit.
Figure 15:
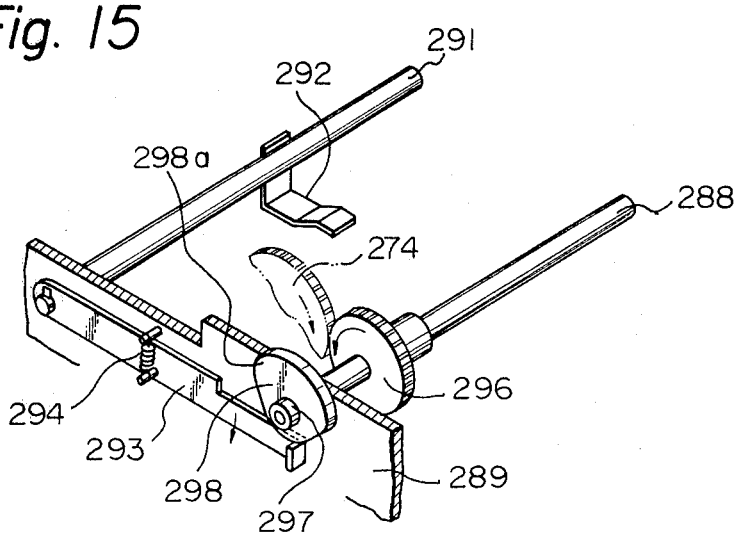
FIG. 15 is a perspective view of a cam arrangement for the developing unit.

The developing unit 39 is shown in FIGS. 14 to 16 as comprising a cylinder 271 fixed to a shaft 272 which is rotatably supported by a frame 273. Although not visible, magnets are disposed inside the cylinder 271. A gear 274 meshes with a gear 276 through an idler gear 277. The gear 276 is mounted on a shaft 278 which is rotatably supported by the frame 273 and which in turn supports an applicator roller 279. A developing tank 281 is attached to the frame 273 and encloses the lower portions of the cylinders 271 and 279. The tank 281 contains dry or liquid toner. Clockwise rotation of the gear 274 causes the cylinders 271 and 279 to both rotate clockwise. The cylinder 279 picks up toner from the tank 281 and applies it to the cylinder 271 to form a magnetic brush of toner thereon. The cylinder 271 applies the toner to the belt 27 for development. Further illustrated are a doctor blade 282 and a shaft 283 by which the blade 282 is rotatably supported by the frame 273. The shaft 283 and blade 282 are urged clockwise by means of a spring 284 and arm 286 so that the blade 282 engages the cylinder 271 with a predetermined force and limits the thickness of the magnetic brush to a predetermined value.

The frame 273 is formed with semicircular cutouts 287 (only one is visible). A shaft 288 is rotatably supported by a frame member 289 and another frame member which is not visible. Another shaft 291 is rotatably supported in the same manner. An arm 292 is fixed to the shaft 291. An arm 293 which bifunctions as a support member and a cam follower is fixed to the end of the shaft 291 and urged to an upward position by a spring 294. The developing unit 39 is detachably mounted in the upper portion of the housing 22 merely by hooking the cutouts 287 over the shaft 288 and lowering the opposite end portion of the developing tank 281 onto the arm 292. The developing unit 39 is supported by the arms 292 and 293 and spring 294.

Upon insertion of the developing unit 39 into the housing 22, the gear 274 meshes with a gear 296 fixed to the shaft 288. The developing unit 39 may be rocked around the shaft 288 while maintaining the gears 274 and 296 in mesh since the distance between the shafts 272 and 288 is equal to the sum of the radii of the gears 274 and 296.

The shaft 288 is connected to the drive unit 64 through a clutch 297. A cam 298 is fixed to the shaft 288 and has a cam surface which engages with the upper surface of the free end of the arm 293. The arm 293, which functions as a cam follower, is maintained in engagement with the cam 298 by the spring 294. The spring 294 is strong enough to support the weight of the developing unit 39.

As discussed above, it is desirable to move the cylinder 271 away from the belt 27 while the belt 27 is not moving to prevent sticking of toner to the belt 27 in an erroneous manner. This is accomplished by the arrangement illustrated.

During imaging exposure while the belt 27 is stopped, the clutch 297 is disengaged so that the shaft 288 is not rotated. The disengagement of the clutch 297 is timed so that a maximum radius portion **298*a* of the cam 298 engages the arm 293. This causes the arm 293 to rotate downwardly (clockwise) and rotate the shaft 291 and arm 292 clockwise. This lowers the arm 292 so that the frame 273 rotates or rocks counterclockwise about the shaft 288. This rotation moves the developing unit 39 downwardly, away from the belt 27, so that the magnetic brush on the cylinder 271 disengages from the belt 27**.

For development when the belt 27 is rotated, the clutch 297 is engaged for one rotation. The maximum radius portion **298*a* of the cam 298 moves away from the arm 293 so that the arm 293 is moved upwardly by the spring 294. This moves the developing unit 39 upwardly so that the magnetic brush engages with the belt for development. Engagement of the clutch 297 also rotates the shaft 288 and thereby the cylinders 271 and 279** for development.

The easy detachment of the developing unit 39 makes assembly, cleaning and maintenance very easy merely by raising the cover 24. It also facilitates adding toner into the developing tank 281 since the tank 281 is readily accessible from the top of the housing 22.

Figure 17:
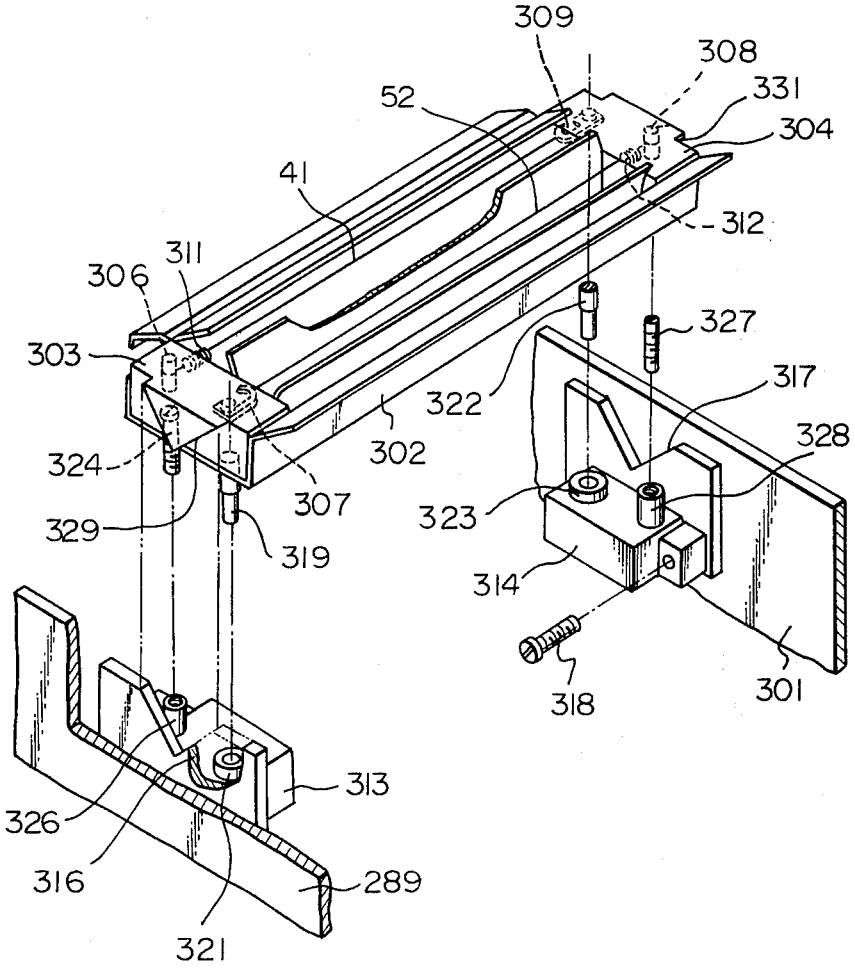
FIG. 17 is a partially exploded view of a transfer unit.

The transfer charger 41 and separation charger 52 are illustrated in FIG. 17 as being in the form of wire electrodes. A frame 302 receives insulator blocks 303 and 304 at the opposite ends thereof. A post 306 and a hook 307 are fixed to the block 303 whereas a post 308 and hook 309 are fixed to the block 304. The transfer charger electrode 41 extends between the post 306 and hook 309 with a spring 311 provided for producing tension. The separation charger electrode 52 extends between the post 308 and hook 307 with a spring 312 provided to produce tension.

Blocks 313 and 314 having V-cutouts 316 and 317 are fixed to the frame member 289 and a frame member 301 by screws 318. A terminal 319 extends from the hook 307 through a terminal tube 321 provided in the block 313 for external connection to an A.C. high voltage source (not shown). A terminal 322 extends from the hook 309 through a terminal tube 323 provided in the block 314 for external connection to a D.C. high voltage source (not shown). The block 303 is fixed to the block 313 by means of a screw 324 and an internally threaded tube 326 fixed to the block 313. The screw 324 screws into the block 303. The blocks 304 and 314 are similarly attached together by means of a screw 327 and tube 328. The blocks 303 and 304 are formed with V-projections 329 and 331 which fit in the cutouts 316 and 317 respectively for perfect positioning of the assembly in the housing 22.

The units 41 and 52 are easily detached from and attached to the top portion of the housing 22 in the manner described, thereby providing ease of manufacture and maintenance. This is far superior to prior art copying machines in which the corresponding units must be removed longitudinally. The integral mounting of the units 41 and 52 further facilitates ease of manufacture and maintenance.

The unique arrangement of the component units in the present copying machine 21 offers numerous advantageous which far exceed the advantageous of conventional units assembled in aggregation.

Jammed sheets may be easily removed from the copying machine 21 by raising the cover 24. This permits easy access to the sheet feed path from the area below the roller 29 to the roller 57.

Maintenance is extremely easy due to the combination of the openability of the cover 24, the detachable mounting of the various units such as the developing unit 39, cleaning unit 61 and fixing unit 54 which are detachable integrally and the fact that the belt 27 may be easily detached providing access to the imaging unit 32.

The fact that the cover 24 may be opened makes it easy to supply toner into the developing unit 39. The developing unit 39 is readily detachable and can be maintained easily. The transfer and separation chargers 41 and 52 are unitary, and may be detached and repaired easily.

The overall dimensions of the copying machine 21 are reduced over the prior art since the cassettes 44 and 46 are completely received in the housing 22. The height of the copying machine 21 is reduced due to the fact that the belt 27 extends laterally and because the developing and transfer units 39 and 41 respectively are located at opposite ends of the belt 27. The focussing optical fiber array 36 further reduces the height of the copying machine 21 compared to a mirror and lens system.

The curtain 181 reduces the lateral dimension of the copying machine 21 since it is thin and wound around the rollers 182 and 183. If the curtain 181 were replaced by rigid plates as in the prior art, the width of the copying machine 21 would have to be substantially increased to accommodate the stroke of the imaging unit 32 and the plates.

In summary, it will be seen that the present invention provides ease of maintenance, removal of jammed sheets and reduced size compared to the prior art due to a novel and unique arrangement. Various modifications will become possible for those skilled in the art after receiving the teachings of the present disclosure without departing from the scope thereof.

What is claimed is:

1. An electrostatic copying machine comprising:
a housing;
a cover provided on top of the housing and being movable between open and closed positions;
first and second parallel rollers rotatably supported by the cover;
an endless photoconductive belt trained around the first and second rollers;
imaging means provided in the cover for forming an electrostatic image of an original document on a portion of the belt between the first and second rollers;
developing means provided in the housing for developing the electrostatic image to produce a toner image, the developing means being adjacent to the first roller when the cover is in the closed position;
transfer means provided in the housing for transferring the toner image to a copy sheet, the transfer means being adjacent to the second roller when the cover is in the closed position;
drive means for rotating the first and second rollers and thereby the belt in a direction such that the portion of the belt on which the electrostatic image is formed moves around the first roller and then around the second roller;
control means for controlling the imaging means, drive means and transfer means in such a manner that, for multiple copying operation, the belt is alternatingly stopped while the imaging means forms an electrostatic image thereon and driven for one half revolution; and
feed means provided in the housing for feeding the copy sheet, the feed means being selectively controllable for discharging the copy sheet after transfer of the toner image to one side thereof and inverting and feeding the copy sheet to the belt after toner image transfer another toner image to another side of the copy sheet prior to discharge of the copy sheet.

2. An electrostatic copying machine comprising:
a housing;
a cover provided on top of the housing and being movable between open and closed positions;
first and second parallel rollers rotatably supported by the cover;
an endless photoconductive belt trained around the first and second rollers;
imaging means provided in the cover for forming an electrostatic image of an original document on a portion of the belt between the first and second rollers;
developing means provided in the housing for developing the electrostatic image to produce a toner image, the developing means being adjacent to the first roller when the cover is in the closed position;
transfer means provided in the housing for transferring the toner image to a copy sheet, the transfer means being adjacent to the second roller when the cover is in the closed position;
drive means for rotating the first and second rollers and thereby the belt in a direction such that the portion of the belt on which the electrostatic image is formed moves around the first roller and then around the second roller; and
control means for controlling the imaging means, drive means and transfer means in such a manner that, for multiple copying operation, the belt is alternatingly stopped while the imaging means forms an electrostatic image thereon and driven for one half revolution;
the control means further controlling the imaging means, drive means and transfer means in such a manner that, for single copying operation, the belt is stopped while the imaging means forms an electrostatic image thereon and then driven for one revolution.

3. A copying machine as in claim 1, further comprising cleaning means provided in the cover and engaging the belt adjacent to the second roller downstream of the transfer means in the direction of movement of the belt, the cleaning means being detachable from a bottom of the cover.

4. A copying machine as in claim 3, in which the cleaning means comprises a rotary member, the copying machine further comprising means for rotating the rotary member while the belt is moving and stopping the rotary member while the belt is stopped.

5. An electrostatic copying machine comprising:
a housing;
a cover provided on top of the housing and being movable between open and closed positions;
first and second parallel rollers rotatably supported by the cover;
an endless photoconductive belt trained around the first and second rollers;
imaging means provided in the cover for forming an electrostatic image of an original document on a portion of the belt between the first and second rollers;
developing means provided in the housing for developing the electrostatic image to produce a toner image, the developing means being adjacent to the first roller when the cover is in the closed position;
transfer means provided in the housing for transferring the toner image to a copy sheet, the transfer means being adjacent to the second roller when the cover is in the closed position;
drive means for rotating the first and second rollers and thereby the belt in a direction such that the portion of the belt on which the electrostatic image is formed moves around the first roller and then around the second roller;

control means for controlling the imaging means, drive means and transfer means in such a manner that, for multiple copying operation, the belt is alternatingly stopped while the imaging means forms an electrostatic image thereon and driven for one half revolution; and cleaning means provided in the cover and engaging the belt adjacent to the second roller downstream of the transfer means in the direction of movement of the belt, the cleaning means being detachable from a bottom of the cover;

the cleaning means comprising a rotary member, the copying machine further comprising means for rotating the rotary member while the belt is moving and stopping the rotary member while the belt is stopped;

the rotary member comprising a fur brush, the cleaning means further comprising a flicker bar for flickingly removing toner from the brush, a roller for conveying the removed toner around a circular path and a rotating worm disposed at an end of the circular path for conveying the toner away for reuse.

6. A copying machine as in claim 1, in which the developing means is detachable from a top of the housing.

7. An electrostatic copying machine comprising:

a housing;

a cover provided on top of the housing and being movable between open and closed positions;

first and second parallel rollers rotatably supported by the cover;

an endless photoconductive belt trained around the first and seconc rollers;

imaging means provided in the cover for forming an electrostatic image of an original document on a portion of the belt between the first and second rollers;

developing means provided in the housing for developing the electrostatic image to produce a toner image, the developing means being adjacent to the first roller when the cover is in the closed position;

transfer means provided in the housing for transferring the toner image to a copy sheet, the transfer means being adjacent to the second roller when the cover is in the closed position;

drive means for rotating the first and second rollers and thereby the belt in a direction such that the portion of the belt on which the electrostatic image is formed moves around the first roller and then around the second roller;

control means for controlling the imaging means, drive means and transfer means in such a manner that, for multiple copying operation, the belt is alternatingly stopped while the imaging means forms an electrostatic image thereon and driven for one half revolution; and means for moving the developing means into engagement with the belt when the belt is moving and moving the developing means out of engagement with the belt when the belt is stopped.

8. A copying machine as in claim 7, in which said means for moving the developing means comprises a shaft rockingly supporting an end of the developing means, a rockable arm supporting another end of the developing means and cam means for rocking the arm between a first position in which the developing means is rocked upwardly into engagement with the belt and a second position in which the developing means is rocked downwardly out of engagement with the belt.

9. A copying machine as in claim 8, in which the developing means comprises a rotary magnetic brush, a first gear fixed to the magnetic brush and a second gear fixed to the shaft and meshing with the first gear, the cam means comprising a cam fixed to the shaft and a cam follower fixed to the arm.

10. A copying machine as in claim 1, further comprising a frame which rotatably supports the first and second rollers and thereby the belt, the frame being detachable from a bottom of the cover.

11. A copying machine as in claim 1, further comprising thermal fixing means for fixing the toner image to the copy sheet, the fixing means being provided in the cover and being detachable from a bottom of the cover.

12. An electrostatic copying machine comprising:

a housing;

a cover provided on top of the housing and being movable between open and closed positions;

first and second parallel rollers rotatably supported by the cover;

an endless photoconductive belt trained around the first and second rollers;

imaging means provided in the cover for forming an electrostatic image of an original document on a portion of the belt between the first and second rollers;

developing means provided in the housing for developing the electrostatic image to produce a toner image, the developing means being adjacent to the first roller when the cover is in the closed position;

transfer means provided in the housing for transferring the toner image to a copy sheet, the transfer means being adjacent to the second roller when the cover is in the closed position;

drive means for rotating the first and second rollers and thereby the belt in a direction such that the portion of the belt on which the electrostatic image is formed moves around the first roller and then around the second roller;

control means for controlling the imaging means, drive means and transfer means in such a manner that, for multiple copying operation, the belt is alternatingly stopped while the imaging means forms an electrostatic image thereon and driven for one half revolution; and thermal fixing means for fixing the toner image to the copy sheet, the fixing means being provided in the cover and being detachable from a bottom of the cover;

the fixing means being disposed downstream of the second roller in a direction of movement of a lower run of the belt.

13. A copying machine as in claim 12, in which the fixing means comprises a flash tube.

14. An electrostatic copying machine comprising:

a housing;

a cover provided on top of the housing and being movable between open and closed positions;

first and second parallel rollers rotatably supported by the cover;

an endless photoconductive belt trained around the first and second rollers;

imaging means provided in the cover for forming an electrostatic image of an original document on a portion of the belt between the first and second rollers;

developing means provided in the housing for developing the electrostatic image to produce a toner image, the developing means being adjacent to the first roller when the cover is in the closed position;

transfer means provided in the housing for transferring the toner image to a copy sheet, the transfer means being adjacent to the second roller when the cover is in the closed position;

drive means for rotating the first and second rollers and thereby the belt in a direction such that the portion of the belt on which the electrostatic image is formed moves around the first roller and then around the second roller; and control means for controlling the imaging means, drive means and transfer means in such a manner that, for multiple copying operation, the belt is alternatingly stopped while the imaging means forms an electrostatic image thereon and driven for one half revolution;

the imaging means comprising a transparent platen defining a portion of a top of the cover and a movable scanning unit provided in the cover between the platen and belt for charging an upper run of the belt and radiating a light image of the document thereon.

15. A copying machine as in claim 14, in which the imaging means comprises a charger for charging the belt, a light source for illuminating a linear portion of the document, a focussing optical fiber array for focussing a light image of said linear portion onto the belt and drive means for moving the charger, light source and array relative to the belt.

16. A copying machine as in claim 15, further comprising third and fourth rollers rotatably supported in the cover and a curtain having ends would around third and fourth rollers respectively, the curtain extending between the platen and the belt, being connected to the charger, light source and array for integral movement and being formed with an opening which allows light from the document to reach the belt only through the array, the copying machine further comprising biasing means for urging the third and fourth rollers to rotate in directions such as to maintain the curtain taut.

17. A copying machine as in claim 1, in which the transfer means is detachable from a top of the housing.

18. A copying machine as in claim 17, in which the transfer means comprises a transfer charger.

19. A copying machine as in claim 1, further comprising a cassette for supporting the copy sheet, the cassette being completely received in the housing and detachable from a front of the housing.

20. An electrostatic copying machine comprising:

a housing;

a cover provided on top of the housing and being movable between open and closed positions;

first and second parallel rollers rotatably supported by the cover;

an endless photoconductive belt trained around the first and second rollers;

imaging means provided in the cover for forming an electrostatic image of an original document on a portion of the belt between the first and second rollers;

developing means provided in the housing for developing the electrostatic image to produce a toner image, the developing means being adjacent to the first roller when the cover is in the closed position;

transfer means provided in the housing for transferring the toner image to a copy sheet, the transfer means being adjacent to the second roller when the cover is in the closed position;

drive means for rotating the first and second rollers and thereby the belt in a direction such that the portion of the belt on which the electrostatic image is formed moves around the first roller and then around the second roller;

control means for controlling the imaging means, drive means and transfer means in such a manner that, for multiple copying operation, the belt is alternatingly stopped while the imaging means forms an electrostatic image thereon and driven for one half revolution; and a cassette for supporting the copy sheet, the cassette being completely received in the housing and detachable from a front of the housing;

the drive means driving the belt for rotation parallel to the front of the housing, the copying machine further comprising feed means for feeding the copy sheet from the cassette parallel to the front of the housing.

21. An electrostatic copying machine comprising:

a housing;

a cover provided on top of the housing and being movable between open and closed positions;

first and second parallel rollers rotatably supported by the cover;

an endless photoconductive belt trained around the first and second rollers;

imaging means provided in the cover for forming an electrostatic image of an original document on a portion of the belt between the first and second rollers;

developing means provided in the housing for developing the electrostatic image to produce a toner image, the developing means being adjacent to the first roller when the cover is in the closed position;

transfer means provided in the housing for transferring the toner image to a copy sheet, the transfer means being adjacent to the second roller when the cover is in the closed position;

drive means for rotating the first and second rollers and thereby the belt in a direction such that the portion of the belt on which the electrostatic image is formed moves around the first roller and then around the second roller;

control means for controlling the imaging means, drive means and transfer means in such a manner that, for multiple copying operation, the belt is alternatingly stopped while the imaging means forms an electrostatic image thereon and driven for one half revolution; and a cassette for supporting the copy sheet, the cassette being completely received in the housing and detachable from a front of the housing;

the cassette comprising a corner separator disposed at a corner thereof, a corner of the sheet being aligned with a corner of the cassette and a feed roller disposed adjacent to the corner of the cassette for feeding the copy sheet in a direction such that a leading edge of the copy sheet is popped up by the corner separator and skew preventing means disposed upstream of the feed roller in the direction of movement of the copy sheet for engaging with and resisting skew of the copy sheet.

22. A copying machine as in claim 21, in which the skew preventing means comprises a skew preventing roller which is rotatable parallel to the feed roller.

23. A copying machine as in claim 22, in which the skew preventing means comprises a freely rotatable arm, the skew preventing roller being rotatably supported at an end of the arm and being urged into engagement with the copy sheet by gravity.

24. A copying machine as in claim 1, further comprising cleaning means for removing residual toner from the belt after toner image transfer and fixing means for fixing the toner image to the copy sheet, the copying machine further comprising a frame which integrally supports the cleaning means and fixing means, the frame being detachable from a bottom of the cover.

* * * * *